US011466535B2

(12) United States Patent
Arackakudiyil et al.

(10) Patent No.: US 11,466,535 B2
(45) Date of Patent: Oct. 11, 2022

(54) CASING SEGMENT METHODS AND SYSTEMS WITH TIME CONTROL OF DEGRADABLE PLUGS

(71) Applicant: HALLIBURTON ENERGY SERVICES, INC., Houston, TX (US)

(72) Inventors: Zac Suresh Arackakudiyil, Singapore (SG); Gregory Scott Cunningham, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 460 days.

(21) Appl. No.: 15/527,293

(22) PCT Filed: Dec. 18, 2014

(86) PCT No.: PCT/US2014/071021
§ 371 (c)(1),
(2) Date: May 16, 2017

(87) PCT Pub. No.: WO2016/099496
PCT Pub. Date: Jun. 23, 2016

(65) Prior Publication Data

US 2017/0356266 A1 Dec. 14, 2017

(51) Int. Cl.
*E21B 33/12* (2006.01)
*E21B 34/06* (2006.01)
(Continued)

(52) U.S. Cl.
CPC ..... *E21B 33/12* (2013.01); *E21B 34/06* (2013.01); *E21B 34/063* (2013.01); *E21B 47/06* (2013.01); *E21B 49/08* (2013.01)

(58) Field of Classification Search
CPC ..... E21B 33/12; E21B 34/06; E21B 34/063; E21B 47/06; E21B 49/08
See application file for complete search history.

(56) References Cited

U.S. PATENT DOCUMENTS

2007/0215352 A1* 9/2007 Shaw ..... E21B 34/063 166/292
2011/0048708 A1 3/2011 Glasbergen
(Continued)

FOREIGN PATENT DOCUMENTS

WO 2008/050286 5/2008

OTHER PUBLICATIONS

PCT International Preliminary Report on Patentability, dated Dec. 30, 2016, Appl No. PCT/US2014/071021, "Casing Segment Methods and Systems with Time Control of Degradable Plugs," Filed Dec. 18, 2014, 23 pgs.
(Continued)

*Primary Examiner* — Robert E Fuller
*Assistant Examiner* — Neel Girish Patel
(74) *Attorney, Agent, or Firm* — Scott Richardson; Parker Justiss, P.C.

(57) ABSTRACT

A casing segment comprising a cylinder, a downhole tool, a first channel in the cylinder, a degradable plug wherein the plug degrades when exposed to a degrading fluid, said degrading fluid concurrently not degrading to the cylinder or the downhole tool, and a fluid reservoir that stores the degrading fluid, wherein the fluid reservoir is in fluid communication with the plug. A method comprising obtaining a casing segment having a cylinder, a downhole tool, and a fluid reservoir with degrading fluid, said degrading fluid concurrently not degrading to the cylinder or the downhole tool, wherein the cylinder includes a first channel, installing a degradable plug within the first channel, deploying the casing segment downhole, and exposing the degradable plug to the degrading fluid to cause the downhole tool to be in fluid communication with the interior surface of the cylinder.

19 Claims, 7 Drawing Sheets

(51) Int. Cl.
*E21B 47/06* (2012.01)
*E21B 49/08* (2006.01)

(56) References Cited

U.S. PATENT DOCUMENTS

2011/0186306 A1* 8/2011 Marya ..... E21B 33/12 166/386
2012/0085548 A1 4/2012 Fleckenstein et al.
2013/0192827 A1* 8/2013 Garcia ..... E21B 23/06 166/281
2014/0020898 A1* 1/2014 Holderman ..... E21B 43/08 166/304
2014/0083689 A1* 3/2014 Streich ..... E21B 34/10 166/250.15
2014/0174757 A1 6/2014 Fripp et al.
2014/0318780 A1* 10/2014 Howard ..... E21B 34/06 166/285
2015/0308238 A1* 10/2015 Langlais ..... E21B 43/04 166/278
2015/0330191 A1* 11/2015 Holderman ..... E21B 34/063 166/205
2016/0201448 A1* 7/2016 Patel ..... E21B 47/007 73/152.51
2016/0251912 A1* 9/2016 Marcuccio ..... E21B 37/06 166/376

OTHER PUBLICATIONS

PCT International Search Report and Written Opinion, dated Aug. 24, 2015, Appl No. PCT/US2014/071021, "Casing Segment Methods and Systems with Time Control of Degradable Plugs," Filed Dec. 18, 2014, 16 pgs.

* cited by examiner

CASING SEGMENT METHODS AND SYSTEMS WITH TIME CONTROL OF DEGRADABLE PLUGS

BACKGROUND

The present disclosure is related to protecting downhole tools during wellbore cementing operations. In the oil and gas industry, wellbores are drilled into the Earth's surface in order to access underground formations containing hydrocarbons. Once a wellbore is drilled, it is often lined with casing segments or a string of hollow cylindrical casing lengths, (called a "casing string"). Thereafter, the casing string is secured into place using cement. In one cementing technique, a cement composition is pumped through the interior of the casing string and allowed to flow back towards the surface through an annulus between the wellbore wall and the casing. The cement composition within the annulus is then allowed to cure, forming a hardened mass. The cemented casing string serves to stabilize the walls of the surrounding subterranean formation to prevent any potential caving of the wellbore. The casing also isolates the various surrounding subterranean formations by preventing the flow or cross-flow of formation fluids via the annulus. The casing further provides a surface to secure pressure control equipment and downhole production equipment, such as a drilling blowout preventer (BOP) or a production packer.

In some applications, one or more downhole tools may be run downhole with the casing and permanently installed therewith, meaning that the downhole tools are meant to remain within the casing throughout the life of the well. Such downhole tools are typically arranged on the exterior of a casing segment coupled to the casing string at a pre-determined location in the wellbore. An example of one such downhole tool is a chemical injector, which may remain in fluid communication with a surface location by being ported to the interior of the casing via a channel. Various treatment fluids and/or chemicals may be conveyed from the surface to the chemical injector to be injected into the casing via the channel for various purposes. Another exemplary downhole tool is a gauge mandrel that includes various gauges and/or sensors that are ported to the interior of the casing via a channel. Such gauges may monitor the fluids circulating in the casing and report real-time fluid parameters (i.e., temperature, pressure, etc.) to a surface location (e.g., via wired or wireless communications). However, while cementing the casing within the wellbore, the cement composition and/or other wellbore debris may obstruct, block, or otherwise occlude the channel that provides fluid communication between the downhole tool and the interior of the casing. If the channel is obstructed, then operation of the downhole tool will likely be frustrated.

To prevent the influx of the cement composition or other wellbore debris such as rock particles or metal chips into the channel, a burst disk may be utilized, which is typically arranged within the channel. Following placement of the cement composition, the casing may be pressurized to rupture the burst disk and thereby initiate fluid communication between the downhole tool and the interior of the casing.

BRIEF DESCRIPTION OF THE DRAWINGS

Accordingly, there are disclosed in the drawings and the following description casing segment methods and systems with time control of degradable plugs.

Figure 1:
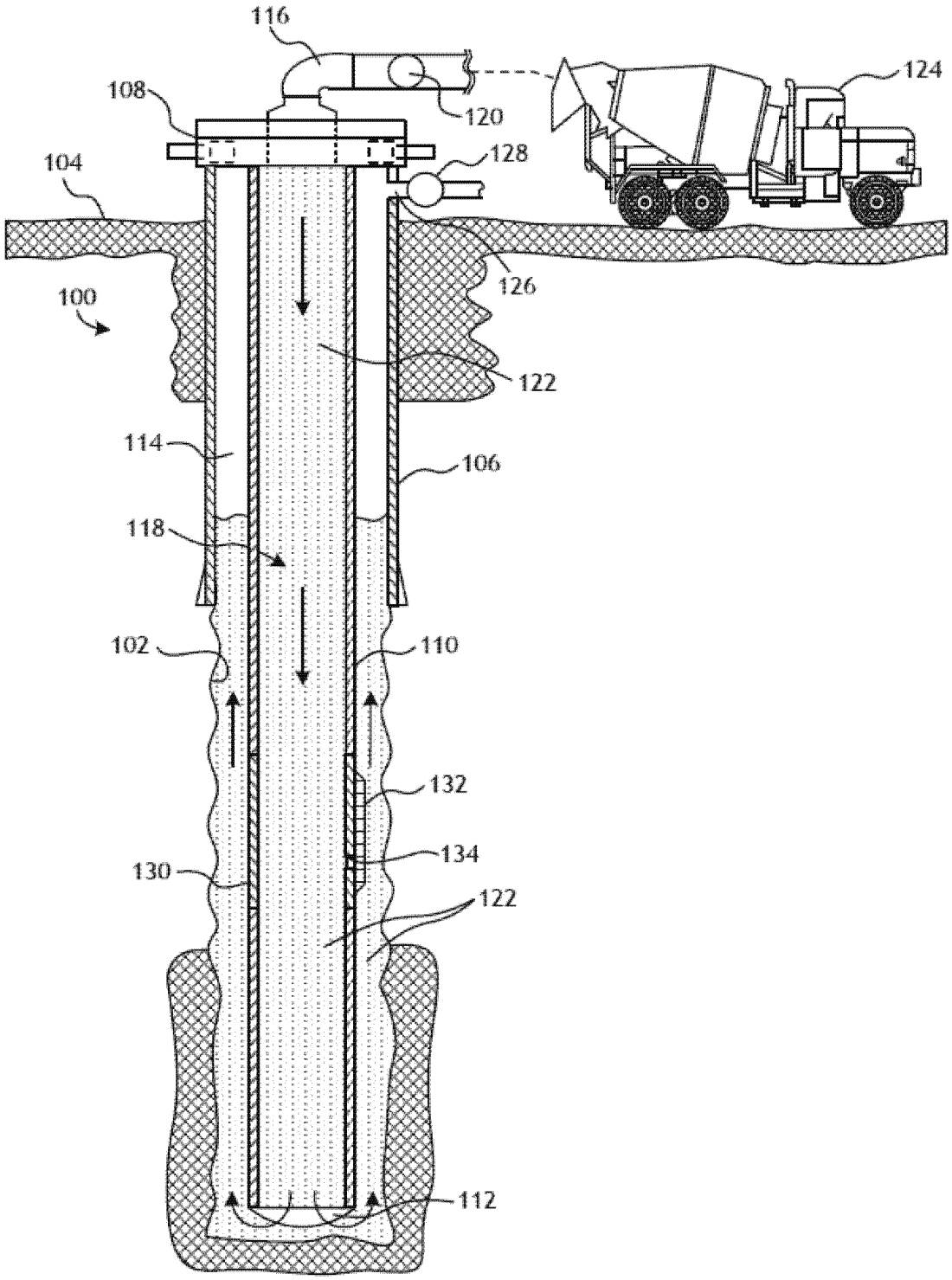
FIG. 1 is an illustrative cross-sectional side view of a wellbore system.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

Described herein are casing segment methods and systems with time control of degradable plugs. Included in this disclosure are options including: a fluid reservoir to be located in the interior of the downhole tool; one of more contact points between the degrading fluid and the degradable plug; a controllable valve to prevent the degrading fluid from being released until a desired time; an option for circulating the degrading fluid to ensure the most potent fluid is in contact with the at least one degradable plug; options for constructing the degradable plug, and fluid control options including circulating the fluid and controlling the fluid with a valve. The disclosed methods and systems are used, for example, in a downhole scenario where cementing could interfere with the operation of a downhole tool. To reduce such interference, the degradable plug material and/or time control options for a degradable plug are carefully selected or managed as described herein.

The methods and systems disclosed herein include, for example, a degradable plug used to plug a channel leading from an interior of a casing segment to a downhole tool associated with the casing segment. The degradable plug prevents cement from entering a gauge port. A degradable plug as described herein requires no operator intervention to start the gauge reading or allow a chemical injector access to the wellbore fluids. The degradable plug would later degrade away automatically because of the action of the degrading fluid, wellbore fluids, and/or environmental conditions downhole. The degradable plug, among other things, prevents wellbore debris from entering and plugging an inlet to the channel, which would otherwise render the downhole tool unsuitable for its intended purpose. The degradable plug may degrade or dissolve after a period of time following exposure to a particular fluid encased in the downhole tool, after which fluid communication between the interior of the casing segment and the downhole tool may be established. The downhole tool may then be able to fluidly communicate with the interior of the casing segment via the channel.

The teachings of the present disclosure may be particularly useful in running a cementing operation to secure a casing string within a wellbore. The casing string may have a casing segment arranged between upper and lower portions of the casing string and a downhole tool may be arranged on the casing segment. The degradable plug may be arranged within a channel leading to the downhole tool and thereby prevent the cement composition and other wellbore debris from entering the channel. Once the cementing operation is completed, the degradable plug may degrade or dissolve to allow the downhole tool to access the fluids circulating through the casing string.

FIG. 1 is a cross-sectional side view of a wellbore system 100 that may employ one or more of the principles of the present disclosure. More particularly, FIG. 1 depicts a wellbore 102 that has been drilled into the Earth's surface 104 and a surface casing 106 secured within the wellbore 102 and extending from the surface 104. A wellhead installation 108 is depicted as being arranged at the surface 104 and a casing string 110 is suspended within the wellbore 102 from the wellhead installation 108. A casing shoe 112 may be attached at the bottom-most portion of the casing string 110, and an annulus 114 is defined as the space between the wellbore 102 and the casing string 110.

As used herein, the term "casing string," as in the casing string 110, may refer to a hollow cylindrical casing length extending through a wellbore that may comprise a plurality of hollow cylindrical casing lengths coupled (e.g., threaded) together to form a continuous hollow cylindrical channel of a desired length. It will be appreciated, however, that the casing string 110 may equally refer to a single cylindrical length or structure without departing from the scope of the disclosure.

At the surface 104, a feed line 116 may be operably and fluidly coupled to the wellhead installation 108 and in fluid communication with an interior 118 of the casing string 110. The feed line 116 may have a feed valve 120 configured to regulate the flow of cement 122 into the interior 118 of the casing string 110, and the feed line 116 may be fluidly coupled to a source 124 of cement 122. In the depicted embodiment, the source 124 of the cement 122 is a cement truck, but could equally be a cement head, a standalone pump, or any other pumping mechanism known to persons skilled in the art and capable of introducing the cement 122 into the interior 118 of the casing string 110. A return line 126 may also be connected to the wellhead installation 108 and in fluid communication with the annulus 114. In some cases, as illustrated, the return line 126 may include a return valve 128 configured to regulate the flow of fluids returning to the surface 104 via the annulus 114. In order to secure the casing string 110 within the wellbore 102, cement 122 may be pumped from the source 124 and into the interior 118 of the casing string 110 via the feed line 116. The cement 122 flows to the bottom of the casing string 110 and is diverted at the casing shoe 112 back toward the surface 104 within the annulus 114.

In some embodiments, a casing segment 130 may be arranged on and otherwise incorporated into the casing string 110 at a predetermined location within the wellbore 102. More particularly, the casing segment 130 may be coupled at either end to opposing portions of the casing string 110 and thereby form an integral part or length of the casing string 110. In some embodiments, the casing segment 130 may be threaded into the casing string 110. In other embodiments, the casing segment 130 may be mechanically fastened (e.g., screwed, bolted, pinned, etc.) or welded into the casing string 110 without departing from the scope of the disclosure.

The casing segment 130 may include one or more downhole tools 132 coupled or otherwise attached to its outer surface, and the downhole tool 132 may be ported to the interior 118 of the casing string 110 via a channel 134. In some embodiments, the downhole tool 132 may be a chemical injector configured to inject treatment fluids and/or chemicals into the interior 118 of the casing string 110 via the channel 134. In other embodiments, the downhole tool 132 may be a gauge or sensor configured to monitor the real-time parameters of fluids within the casing string 110 via the channel 134. For example, the gauge or sensor may be in fluid communication with the fluid within the casing string 110 via the channel 134, and the gauge/sensor may be configured to monitor and report the temperature, pressure, flow rate, density, pH, viscosity, etc. of the fluid.

For purposes of this disclosure, the casing segment 130 will be depicted and described herein as a "gauge mandrel" and the downhole tool 132 will depicted and described herein as a "gauge." Those skilled in the art, however, will readily appreciate that the principles of this disclosure may equally apply to a chemical injector mandrel and a chemical injector, respectively, or a sensor mandrel and a sensor, respectfully, or any other mandrel and associated downhole tool configured to be permanently installed in the casing string 110 as described herein.

According to the present disclosure, the channel 134 may be occluded and otherwise plugged with a degradable material so that the cement 122, cement particulates, and/or other wellbore debris may be substantially prevented from obstructing the channel 134 during the cementing operation. After a predetermined amount of time, or following exposure to a particular wellbore environment (e.g., temperature, pressure, fluid, etc.), or exposure to a degradable fluid, the degradable material may be configured to dissolve and thereby establish fluid communication between the downhole tool 132 and the interior 118 of the casing string 110 via a channel 134.

Figure 2A:
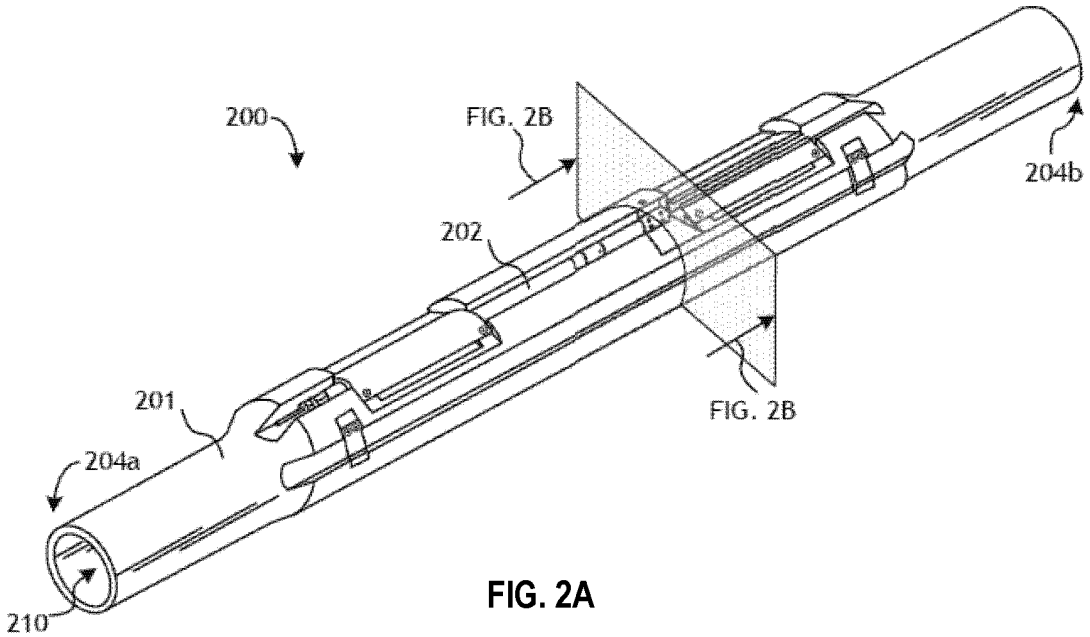
FIGS. 2A, 2B, and 2C are isometric and cross-sectional views showing an illustrative casing segment with a downhole tool.
Figure 2B:
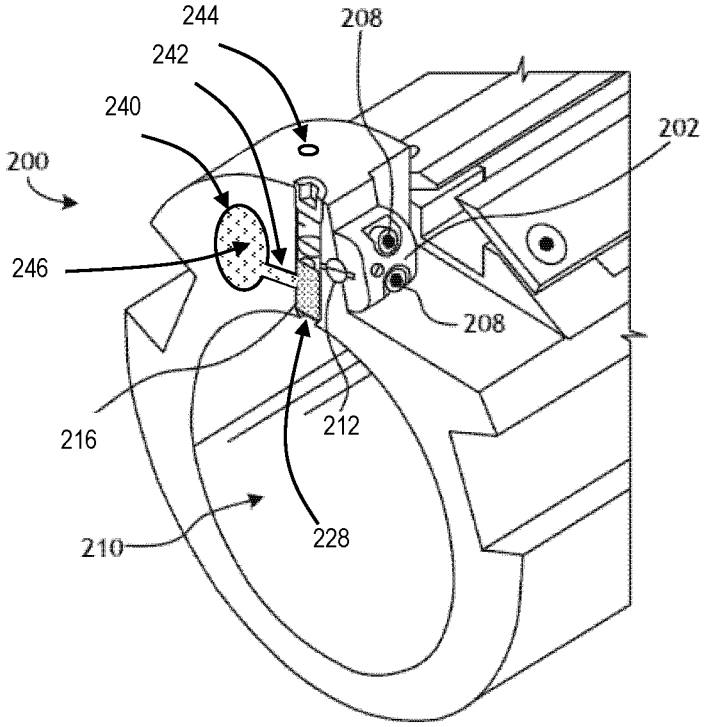
Figure 2C:
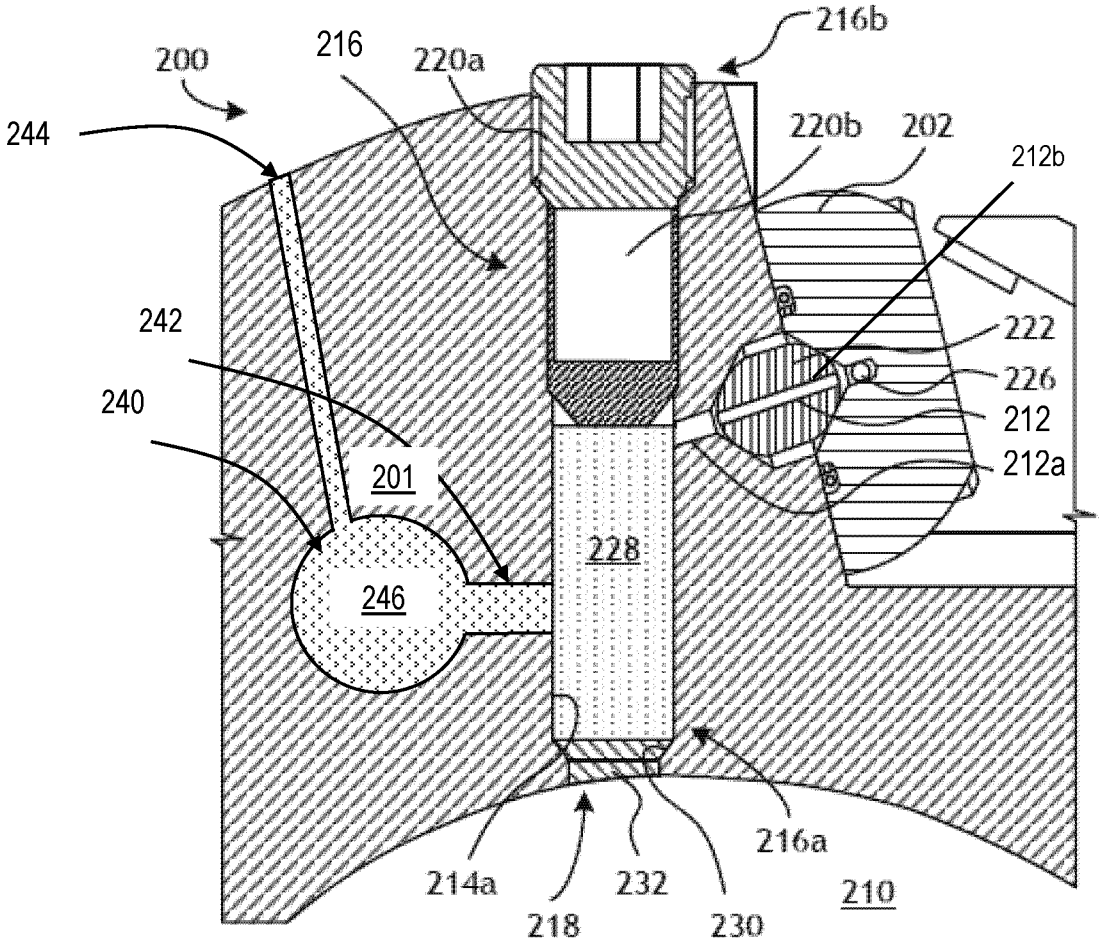

Referring now to FIGS. 2A, 2B, and 2C, with continued reference to FIG. 1, illustrated are various views of an exemplary casing segment 200, according to one or more embodiments of the present disclosure. More particularly, FIG. 2A depicts an isometric view of the casing segment 200, FIG. 2B depicts a cross-sectional isometric view of the casing segment 200 taken at an intermediate location, and FIG. 2C depicts an enlarged end view of the cross-sectional view of the casing segment 200 of FIG. 2B. The casing segment 200 may be similar in some respects to the casing segment 130 of FIG. 1 and may therefore be best understood with reference thereto.

The casing segment 200 may include a generally cylindrical casing segment 201 having a first end 204*a* and a second end 204*b*. At each end 204*a*, 204*b* the casing segment 201 may be configured to be coupled to the casing string 110 (FIG. 1) and thereby form an integral part or length thereof. In other words, the first end 204*a* may be configured to be coupled to an upper portion of the casing string 110 (i.e., extending uphole) and the second end 204*b* may be configured to be coupled to a lower portion of the casing string 110 (i.e., extending downhole). In some embodiments, the casing segment 201 may be threaded at each end 204*a*, 204*b* to the casing string 110, or may alternatively (or in addition thereto) be mechanically fastened (e.g., screwed, bolted, pinned, etc.) or welded to the casing string 110 at each end 204*a*, 204*b*, without departing from the scope of the disclosure. In some embodiments, the casing segment 200 may be a permanent downhole gauge, such as a ROC™ permanent downhole gauge commercially available through Halliburton Energy Services of Houston, Tex., USA. In other embodiments, however, the casing segment 200 may be any other type of casing segment configured to be permanently installed in the casing string 110.

As depicted in FIG. 2A, the casing segment 200 includes a downhole tool 202 that may be operatively coupled to an outer surface of the casing segment 201. The downhole tool 202 may be secured to the casing segment 201 in a variety of ways and, in at least one embodiment, may extend generally longitudinally along the exterior of the casing segment 201. In one or more embodiments (as best seen in FIG. 2B), the downhole tool 202 may be secured to the casing segment 201 using one or more mechanical fasteners 208. In other embodiments, however, the downhole tool 202 may be threaded, welded, and/or brazed to the casing segment 201, without departing from the scope of the disclosure.

Continuing with FIG. 2B, the downhole tool 202 may be used to measure or otherwise monitor fluids flowing within or circulating through the casing segment 201 (FIG. 2A) and, therefore, within and/or through the casing string 110 (FIG. 1) as coupled thereto. To accomplish this, the downhole tool 202 may be in fluid communication with an interior 210 of the casing segment 201 via a first channel 216 defined in the casing segment 201. The first channel 216 may be similar to the channel 134 of FIG. 1 and may encompass or otherwise include one or more channels that extend between the downhole tool 202 and the interior 210 of the casing segment 201. The downhole tool 202 may also include a second channel 212 that intersects the first channel 216 and establishes fluid communication between the downhole tool 202 and the first channel 216. A degradable port plug 228 is installed in the first channel 216. A fluid reservoir 240 is present in the interior of the downhole tool 202 and isolated from exposure to the wellbore fluids present. A degrading fluid 246 is stored in the reservoir 240. The reservoir 240 is in fluid communication via a third channel 242 with the first channel 216 while at the same time, the degrading fluid 246 is isolated from exposure to wellbore fluids such as drilling mud or cement. The reservoir 240 is filled with a degrading fluid 246 at the earth's surface (104 of FIG. 1) via a fill port 244 prior to installation in the casing string. The fill port 244 is sealed with a screw, plug, cap, valve, adhesive, etc. after filling is completed to contain the degrading fluid 246 stored inside.

This disclosure presents the idea of having a degradable plug 228 that will start degrading when it is placed in contact with the degrading fluid 246. The fluid 246 is stored in an interior reservoir 240 inside the downhole tool 201 (FIG. 2A). The fluid 246 may be selected to degrade the degradable plug 246 while, at the same time, not appreciably degrading to the downhole tool 201 or the casing 210. The selection of degrading fluid acidity and composition will determine the length of time the plug 228 will survive before breaking away to allow fluid communication between the interior of the casing 210 and the downhole tool 201 (FIG. 2A). The advantage of this idea is that the plug 228 will degrade from the inside of the downhole tool 201 (FIG. 2A) regardless of the presence/absence of cement. Additionally, the selection of plug/degrading fluid materials allows the operator to choose a period of time before the plug degrades away. This period may be as short as 30 minutes and as long as several weeks. By using such a plug, the downhole tool is isolated and protected from the presence of cement, drilling detritus, and wellbore fluids that could block the port of the downhole tool rendering it useless.

The properties of the plug 228 can be selected based on the degrading fluid 246 present. This must be carefully selected in order to prevent the plug 228 from degrading when in contact with the wellbore fluid. This idea will allow more control over the rate of degradation of the plug. By controlling the degrading fluid 246, the degradable plug 228 could be designed to degrade within hours, days, or weeks of being installed.

Referring specifically to FIG. 2C, the first channel 216 may be defined in the casing segment 201 and provide an inner end 216*a* and an outer end 216*b*. At the inner end 216*a*, the first channel inner end 216*a* may define an inlet 218 that allows fluids from the interior 210 of the casing segment 201 to enter into the channel 216. The outer end 216*b* of the first channel 216 may communicate with the exterior of the casing segment 201. Accordingly, in at least one embodiment, the first channel 216 may be defined through the casing segment 201, from the exterior to the interior 210 thereof.

Continuing with FIG. 2C, the second channel 212 may include a second channel inner end 212*a* and a second channel outer end 212*b* that fluidly and structurally intersects and is in fluid communication with the first channel 216. In the illustrated embodiment, one or more port plugs (shown as first and second port plugs 220*a* and 220*b*) may be disposed within the first channel 216 at or near the outer end 216*b*. The first port plug 220*a* may be a threaded plug configured to be threaded into the first channel outer end 216*b*. The second port plug 220*b* may be an expansion plug, such as a commercially available LEE PLUG®. The first and second port plugs 220*a*, 220*b* may be useful in preventing wellbore debris from entering the first channel outer end 216*b* via the exterior of the casing segment 201. In at least one embodiment, however, one of the first or second port plugs 220*a*, 220*b* may be omitted without departing from the scope of the disclosure.

The second channel 212, comprised of inner end 212*a* and outer end 212*b*, may fluidly and structurally intersect the first channel 216 at an intermediate location between the first channel inner and outer ends 216*a*, 216*b* and may be in direct fluid communication with the downhole tool 202. Accordingly, the second channel 212 may be characterized or otherwise referred to herein as a "gauge port," or the second channel 212 that leads directly into the downhole tool 202. In some embodiments, a metal-to-metal seal 222 may be arranged in the second channel 212*b* and have a weep hole 226 defined therethrough. The metal-to-metal seal 222 may be secured within the second channel 212*b* as the downhole tool 202 is secured to the casing segment 201 using the mechanical fasteners 208 (FIG. 2B). The curved or arcuate ends of the metal-to-metal seal 222 may help facilitate or otherwise provide a sealed interface between the downhole tool 202 and the second channel 212*b*. The weep hole 226 defined through the metal-to-metal seal 222 may allow a proportioned amount of fluid that enters the channel 212 from the interior 210 of the casing segment 201 to communicate with the downhole tool 202. Any fluids that bypass the weep hole 224 may be allowed to enter the downhole tool 202 that intersects with and extends substantially axially from the second channel 212*b*.

Continuing with FIG. 2C, according to the present disclosure, a first degradable plug 228 may be disposed or otherwise secured within the first channel 216 and used to prevent wellbore debris from obstructing fluid communication between the interior 210 of the casing segment 201 and the downhole tool 202. Exemplary wellbore debris that the degradable plug 228 may be designed to restrict or prevent from entering the first channel 216 may include, but is not limited to, cement (e.g., the cement 122 of FIG. 1), cement particulates, sand, metal shavings, combinations thereof, and the like. In some embodiments, the degradable plug 228 may be threaded into the first channel 216. In other embodiments, the degradable plug 228 may be press fit into the first channel 216. In yet other embodiments, the degradable plug 228 may be secured within the first channel 216 using a combination of both threading and press fitting. In even further embodiments, the degradable plug 228 may be inserted into the first channel 216 and secured therein with at least one of the port plugs 220*a*, 220*b* in addition to, or in place of threading and/or press fitting. In other embodiments, the degradable plug 228 may be secured within the first channel 216 using any other attachment technique including, but not limited to, welding, brazing, adhesives, mechanical fasteners, combinations thereof, and the like.

In the illustrated embodiment, the degradable plug 228 is disposed within the first channel 216 and at least partially secured therein with the first and second port plugs 220*a*, 220*b*. More particularly, threading the first port plug 220*a* into the first channel 216 may have the effect of urging the second port plug 220*b* into axial engagement with one end of the degradable plug 228 while the opposing end of the degradable plug 228 is forced into engagement with a beveled surface 230 of the inlet 218. The degradable plug 228 may be made of a degradable material configured to initially plug or occlude the channel 216 and subsequently degrade or dissolve away, and thereby allow fluid communication between the interior 210 of the casing segment 201 and the downhole tool 202 after a predetermined period of time. As used herein, the term "degradable" refers to any material or substance that is capable of or otherwise configured to degrade or dissolve after a predetermined period of time or following exposure or interaction with a particular downhole environment (e.g., temperature, pressure, a downhole or wellbore fluid), a treatment fluid, etc.

Suitable degradable materials that may be used in accordance with the embodiments of the present disclosure for the degradable plug 228 include polyglycolic acid (PGA), polylactic acid (PLA), and polylactic co-glycolic acid (PLGA), which tend to degrade by hydrolysis as the ambient temperature increases, and which could be pure or laced with fiber materials to change its strength, degradation, acidification or other properties. Other suitable degradable materials include oil-degradable polymers (and any co-polymers thereof), which may be either natural or synthetic polymers and include, but are not limited to, polyacrylics, polyamides, and polyolefins such as polyethylene, polypropylene, polyisobutylene, and polystyrene. Other suitable oil-degradable polymers include those that have a melting point that is such that it will dissolve at the temperature of the subterranean formation in which it is placed, such as a wax material or a degradable rubber.

In addition to oil-degradable polymers, other degradable materials that may be used in conjunction with the embodiments of the present disclosure include, but are not limited to, degradable polymers, dehydrated salts, and/or mixtures of the two. As for degradable polymers, a polymer is considered to be "degradable" if the degradation is due to, in situ, a chemical and/or radical process such as hydrolysis, oxidation, or UV radiation. The degradability of a polymer depends at least in part on its backbone structure. For instance, the presence of hydrolyzable and/or oxidizable linkages in the backbone often yields a material that will degrade, as described herein. The rates at which such polymers degrade are dependent on the type of repetitive unit, composition, sequence, length, molecular geometry, molecular weight, morphology (e.g., crystallinity, size of spherulites, and orientation), hydrophilicity, hydrophobicity, surface area, and additives. Also, the environment to which the polymer is subjected may affect how it degrades, e.g., temperature, presence of moisture, oxygen, microorganisms, enzymes, pH, and the like.

Suitable examples of degradable polymers that may be used in accordance with the embodiments of the present disclosure include, but are not limited to, polysaccharides such as dextran or cellulose; chitins; chitosans; proteins; aliphatic polyesters; poly(lactides); poly(glycolides); poly (ε-caprolactones); poly(hydroxybutyrates); poly(anhydrides); aliphatic or aromatic polycarbonates; poly(orthoesters); poly(amino acids); poly(ethylene oxides); and polyphosphazenes. Combinations, including copolymers, of these may be suitable as well. Of these suitable polymers, as mentioned above, polyglycolic acid and polylactic acid may be preferred.

Polyanhydrides are another type of suitable degradable polymer useful in the embodiments of the present disclosure. Polyanhydride hydrolysis proceeds, in situ, via free carboxylic acid chain-ends to yield carboxylic acids as final degradation products. The erosion time can be varied over a broad range of changes in the polymer backbone. Examples of suitable polyanhydrides include poly(adipic anhydride), poly(suberic anhydride), poly(sebacic anhydride), and poly (dodecanedioic anhydride). Other suitable examples include, but are not limited to, poly(maleic anhydride) and poly(benzoic anhydride).

Dehydrated salts may be used in accordance with the embodiments of the present disclosure as a degradable material. A dehydrated salt is suitable for use in the disclosed embodiments if it will degrade over time as it hydrates. For example, a particulate solid anhydrous borate material that degrades over time may be suitable. Specific examples of particulate solid anhydrous borate materials that may be used include, but are not limited to, anhydrous sodium tetraborate (also known as anhydrous borax), and anhydrous boric acid. These anhydrous borate materials are only slightly soluble in water. However, with time and heat in a subterranean environment, the anhydrous borate materials react with the surrounding aqueous fluid and are hydrated. The resulting hydrated borate materials are highly soluble in water as compared to anhydrous borate materials and as a result degrade in the aqueous fluid. In some instances, the total time required for the anhydrous borate materials to degrade in an aqueous fluid is in the range of from about 8 hours to about 72 hours depending upon the temperature of the subterranean zone in which they are placed. In other applications, the anhydrous borate materials may be configured to degrade in an aqueous fluid in more than 72 hours, such as in the span of a week, two weeks, or longer. Other examples include organic or inorganic salts like acetate trihydrate.

Blends of certain degradable materials may also be suitable. One example of a suitable blend of materials is a mixture of polylactic acid and sodium borate where the mixing of an acid and base could result in a neutral solution where this is desirable. Another example would include a blend of poly(lactic acid) and boric oxide. The choice of degradable material also can depend, at least in part, on the conditions of the well, e.g., wellbore temperature. For instance, lactides have been found to be suitable for lower temperature wells, including those within the range of 150° F. to 350° F., and polylactides have been found to be suitable for well bore temperatures above this range. Also, poly (lactic acid) may be suitable for higher temperature wells. Some stereoisomers of poly(lactide) or mixtures of such stereoisomers may be suitable for even higher temperature applications. Dehydrated salts may also be suitable for higher temperature wells.

Returning to FIG. 2C, in some embodiments the degradable plug may be configured to decompose in the presence of an aqueous fluid. A fluid is considered to be "aqueous" herein if the fluid comprises water alone or if the fluid contains water. Accordingly, while the degradable material may be formed of any material that is suitable for service in a downhole environment and that provides adequate strength to enable proper operation of the degradable plug 228, one should choose the particular material according to the particular pressures and/or temperature ranges to which the degradable plug 228 will be subjected, and should consider the degradation rate and its associated implications on the overall purpose for the use of degradable plug 228. At a given pressure and temperature range, for example, a degradable plug 228 may need to maintain its integrity to, in effect, act as a 30-minute plug, a three-hour plug, a 12-hour plug, a one-day plug, a three-day plug, for example, or any other timeframe desired by the well operator. The choice of degradable material will enhance the outcome and performance of the degradable plug 228. For instance, polylactic acid may be more suitable for longer term uses than anhydrous borate materials at most conventional temperature operations.

In other embodiments, degradable plug 228 may comprise a degradable material that includes a galvanically corrodible metal or material configured to degrade via an electrochemical process in which the galvanically corrodible metal corrodes in the presence of an electrolyte (e.g., brine or other salt fluids in a wellbore). Suitable galvanically corrodible metals include, but are not limited to, gold, gold-platinum alloys, silver, nickel, nickel-copper alloys, nickel-chromium alloys, copper, copper alloys (e.g., brass, bronze, etc.), chromium, tin, aluminum, iron, zinc, magnesium, and beryllium. Combinations of these may be suitable as well.

Accordingly, in some embodiments, the degradable plug 228 may prove advantageous in protecting the downhole tool 202 from wellbore debris, such as cement or cement particulates, during a cementing operation to secure the casing string 110 (FIG. 1) within the wellbore 102. Following the cementing operation, however, the degradable plug 228 may gradually degrade or dissolve away from within the first channel 216 after a predetermined period of time or otherwise after becoming exposed to the wellbore environment (e.g., temperature, pressure, fluids, etc.). Once the degradable plug 228 dissolves away, fluids within the interior 210 of the casing segment 201 may be able to enter the channel 216 via the inlet 218 and access the downhole tool 202 via the first and second channels 216, 212, respectfully.

In some embodiments, it may be desirable to retard the initial degradation rate of the degradable plug 228 while downhole. For instance, a degradable plug 228 comprising PGA may exhibit a material degradation rate that increases as temperature increases. In some applications, it may prove advantageous to slow the initial onset of degradation of the PGA. This may be accomplished by arranging or otherwise disposing a delay plug 232 within the channel 216 and, more particularly, at the inlet 218 to the channel 216. The delay plug 232 may be a solid, cylindrical structure, as illustrated, or may equally be a coating applied to the end of the degradable plug 228.

The delay plug 232 may provide a mechanical boundary that prevents premature degradation of the degradable plug 228. In some embodiments, the delay plug 232 may be configured to degrade at a rate that is slower than the degradable plug 228. The configuration of the delay plug 232 may involve a different choice of degradable material from those disclosed herein (e.g., a material that is more stable than PGA at the encountered temperature and pressures), or it may involve a choice of a different type of material all together. For example, a different type of material for the delay plug 232 may include, but is not limited to, wax, grease, oil, dissolvable rubber, and any combination thereof. Accordingly, the delay plug 232 may be configured to degrade at a slow rate, as compared to the degradable plug 228, but will eventually degrade and/or dissolve. With the delay plug 232 dissolved, the degradable plug 228 may then be exposed to the wellbore environment via the inlet 218 and any wellbore or treatment fluids present therein, which may initiate degradation of the degradable plug 228.

In other embodiments, the delay plug 232 may be non-degradable and otherwise made of a material that does not degrade or dissolve in a wellbore environment. Exemplary non-degradable materials that may be used in such embodiments include, but are not limited to, paint, TEFLON®, rubber, ceramics, metals, combinations thereof, and the like. In embodiments where the delay plug 232 is non-degradable, the delay plug 232 may define or otherwise provide a small weep hole (not shown) that provides fluid communication between the interior 210 of the casing segment 201 and the degradable plug 228. In such embodiments, the degradable plug 228 may be exposed to the wellbore environment via the weep hole in the delay plug 232 and, therefore, may begin degrading immediately. However, since the weep hole only allows a small amount of the wellbore and/or treatment fluids present within the interior 210 of the casing segment 201 to contact the degradable plug 228, it will require a longer period of time before the entire cross-sectional area of the degradable plug 228 dissolves.

In some embodiments, a delay plug 232 comprising paint may be configured to break into several small pieces and eventually be washed out of the casing segment 200. In some embodiments, a delay plug 232 made of TEFLON®, rubber, ceramics, and metals, however, may be configured or otherwise designed to dislodge from the first channel 216 once the degradable plug 228 degrades sufficiently, and thereby allow communication to the interior 210 of the casing segment 201.

As will be appreciated, the addition of the delay plug may prove advantageous in reducing the required length of the degradable plug 228, which can decrease the overall required length of the casing segment 200. Reducing the length of the casing segment 200 may, in turn, reduce costs and reduce or entirely prevent the chance of wellbore debris or cement from obstructing the first channel 216.

In yet other embodiments, the degradation of the degradable plug 228 may be slowed by incorporating two dissimilar degradable materials in the degradable plug 228, dissimilar referring to the degradation properties of the degradable materials. For example, a first portion of the degradable plug 228 may comprise a first material and occupy a portion of the first channel 216 closest to the inlet 218. A second portion of the degradable plug 228 may be comprise a second material and occupy a portion of the first channel 216 further away from the inlet 218 but contiguous with the first portion. The first material may be chosen to degrade at a rate much slower relative to the first material (or vice versa). As a result, the first portion of the degradable plug 228 may be able to occupy a much smaller volume within the first channel 216 than the second portion since it will degrade slower than the second material of the second portion. In the present embodiment, the degradable plug 228 may be made of a material that is immune to degrading when exposed to wellbore fluids in the interior of the casing 210 or the wellbore environment including downhole pressure and temperature. Instead, the degradable plug 228 may be constructed from a material that is both immune to wellbore fluids yet degradable to the degrading fluid 246 present in the reservoir 240.

Figure 3:
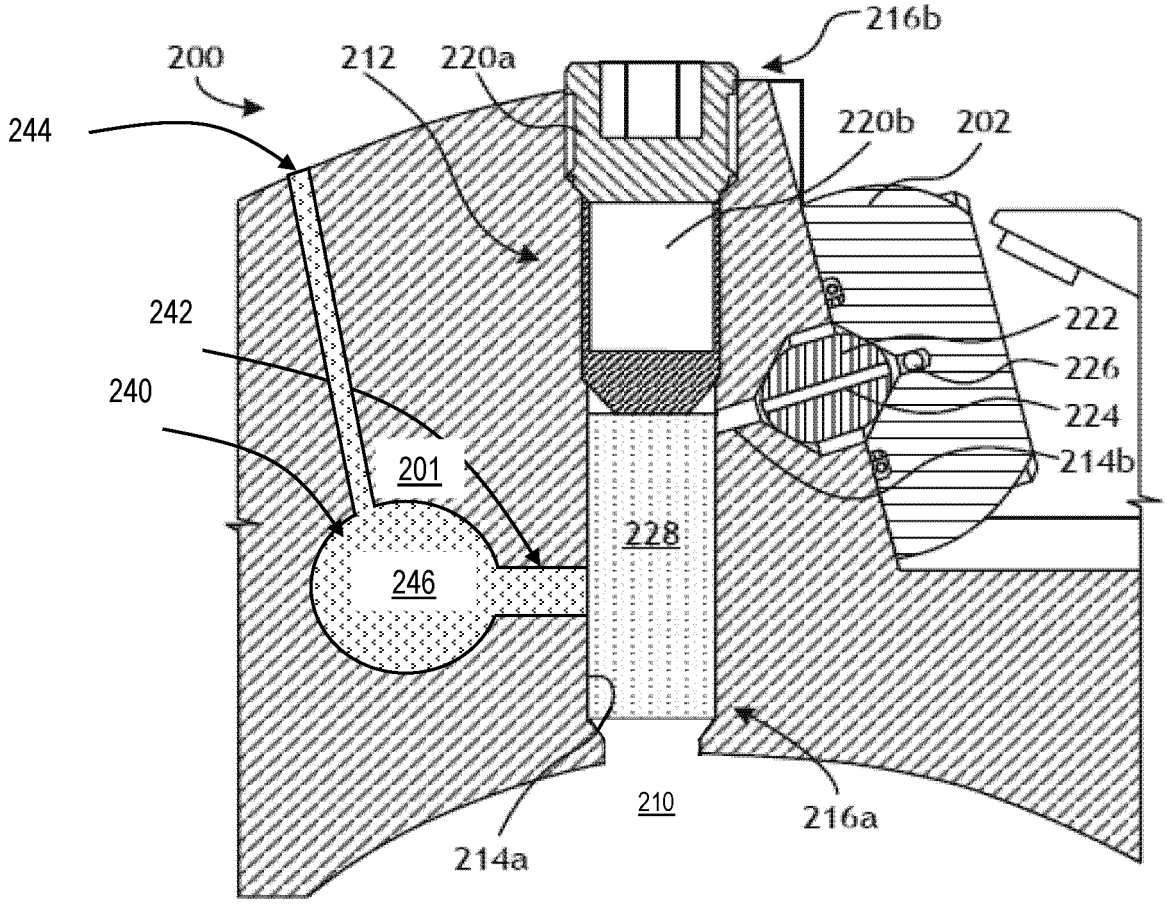
FIG. 3 is a cross-sectional view showing another illustrative casing segment with a degradable plug diagram exposed to both a degrading fluid and a wellbore fluid.

An alternative embodiment is shown in FIG. 3. FIG. 3 is similar to FIG. 2C but with the delay plug 232 absent. In this embodiment, the degradable plug 228 is exposed to both the wellbore fluids 210 and the degrading fluid 246 found in the reservoir 240. In this manner, the plug may degrade at a different rate depending on the composition of both fluids. Selection of the materials of the degradable plug 228 are made with the known compositions of both the degradable fluid 246 and the wellbore fluids in mind, as well as the desired delay time to allow the degradable plug 228 to dissolve.

Figure 4:
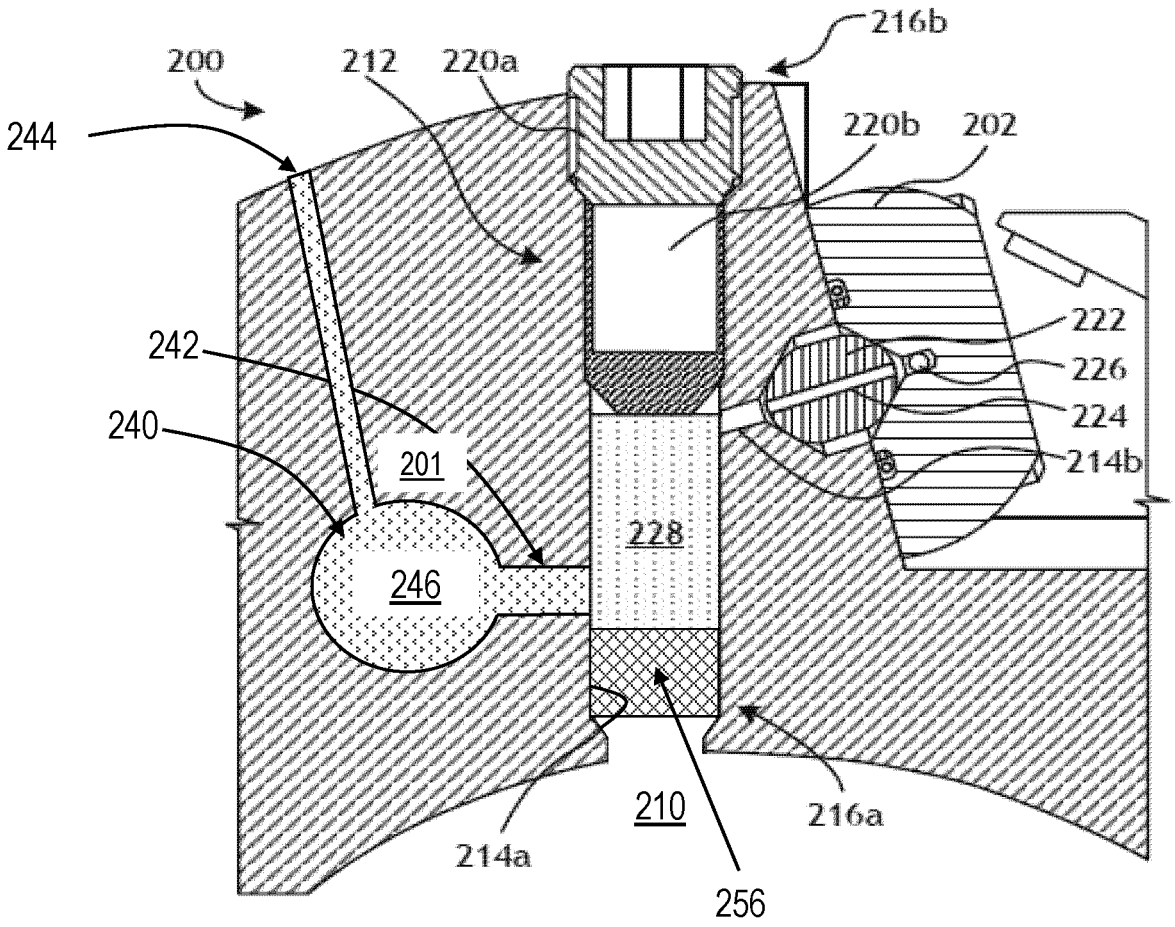
FIG. 4 is a schematic diagram showing an illustrative casing segment with a degradable plug comprised of two materials.

FIG. 4 shows a degradable plug 228 and a delay plug 256. FIG. 4 is similar to FIG. 3 but the addition of a second degradable plug 256. In some embodiments, the degradable plug 228 and second degradable plug 256 may be fixably attached to each other to make a binary-style plug, or the two plugs may be integrated together to form a single mechanical unit. Other embodiments exist. In this embodiment, the binary-style plug, composed of degradable plug 228 and second degradable plug 256, offers additional control of the rate of degrading by requiring both fluids (the wellbore fluid 210 and the degrading fluid 246) to be present before complete degradation of the plug occurs. Other embodiments are possible when employing two or more different materials for the degradable plug 228 and delay plug 256. The materials may be intermixed, layered, segmented, etc. to deliver a user-specified delay in the system.

Figure 5:
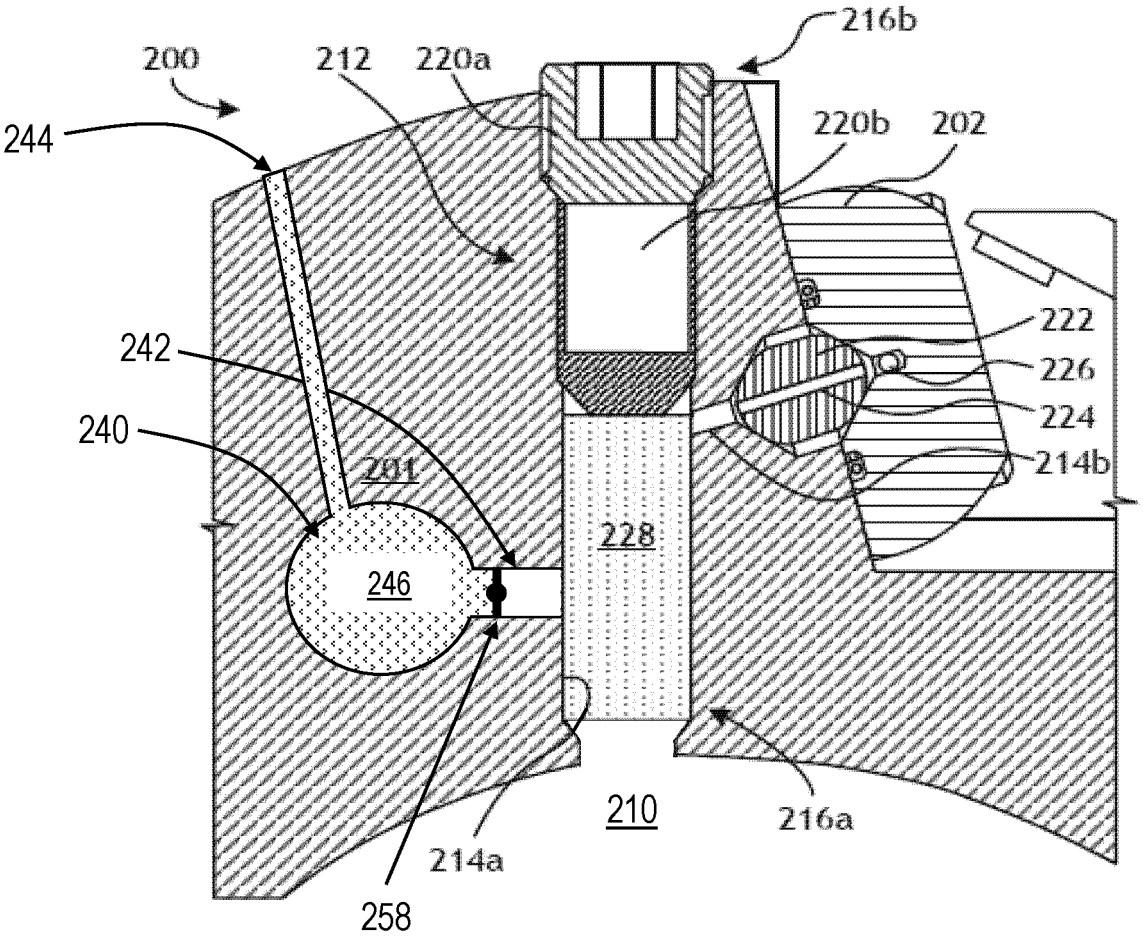
FIG. 5 is a schematic diagram showing an illustrative casing segment with a controllable valve.

FIG. 5 is identical to the device in FIG. 3 but includes the addition of a controllable valve 258 present in the third channel 242. The valve 258 is a mechanical device that retains the degradable fluid 246 in the reservoir 240 until the valve 258 opens. Control of the valve may be of any useable means including, but not limited to a mechanical or electrical timer, mechanical action, electrical control of the valve 258, or any other available means. Used in this way, the controllable valve 258 prevents the degrading fluid 246 from contacting and interacting with the degradable plug 228 until a length of time or an event has passed as the casing segment is being installed downhole, said time being controlled by a surface operator.

Figure 6:
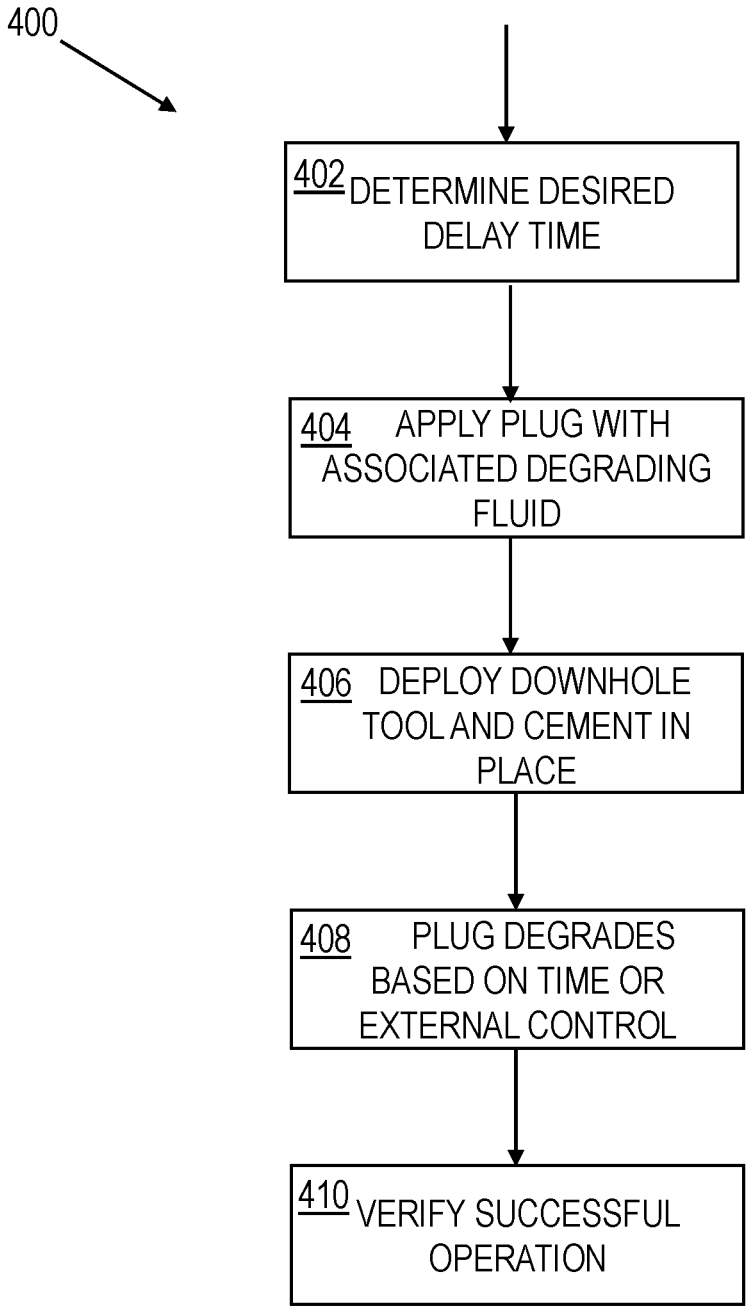
FIG. 6 is a block diagram describing degradable plug employment and degradation.

The block diagram in FIG. 6 is a method for controlling the plug degradation rate by operator steps taken both before and after deployment of the downhole tool into a wellbore. In block 402, before the downhole tool is deployed downhole, the operator determines the desired delay time. Based on this desired time, the operator selects a combination of types of degradable plug and degrading fluid that has been designed to degrade in a given time period. In other embodiments, the operator may select a plug that is degradable to both wellbore fluids and the degrading fluid, or may select a downhole tool employing a controllable valve to prevent any degrading of the plug until commanded to by the operator. In block 404, the operator installs the degradable plug into the downhole tool by using any available means described herein, inserts the appropriate degrading fluid into the fluid reservoir, and caps off the reservoir. In block 406, the downhole tool, complete with an installed plug and filled fluid reservoir, is assembled to the rest of the casing segments and is deployed downhole as part of the casing string assembly. Once installed, the operator commences a cementing process to create a permanent installation of the casing string, including the downhole tool. In block 408, once the degrading fluid is released from the reservoir, degradation of the plug begins. Alternatively, the operator either commands the controllable valve to open, thus allowing the degrading fluid to begin degradation of the plug. Once the plug is totally dissolved, the downhole tool will be in fluid communication with the interior of the wellbore. This process may take minutes, hours, days, or weeks, depending on the selection of plug and fluid material selected by the operator. Finally, at block 410, the operator can verify a successful operation by ensuring the downhole tool is reporting conditions downhole or otherwise effective, depending on the tool or gauge deployed.

Other embodiments employing a degradable plug are also possible, including, but not limited to, employing a method for circulating the degrading fluid within the reservoir with a fluid circulation system to ensure the purest fluid is in physical contact with the degradable plug.

Embodiments disclosed herein include:

A. A casing segment, comprising: a hollow cylinder, a downhole tool operatively coupled to the outside surface of the cylinder, a first channel in the cylinder establishing fluid communication between the downhole tool and an interior surface of the cylinder, a degradable plug deployed within the first channel, wherein the degradable plug is configured to degrade in response to contact with a degrading fluid to cause the downhole tool to be in fluid communication with the interior surface of the cylinder, said degrading fluid concurrently not degrading to the cylinder or the downhole tool, and a fluid reservoir for storing a volume of the degrading fluid, wherein the fluid reservoir is in fluid communication with the at least one degradable plug.

B. A method, comprising: obtaining a casing segment having a cylinder, a downhole tool, and a fluid reservoir with a volume of degrading fluid, wherein the cylinder includes a first channel establishing fluid communication between the downhole tool and an interior surface of the cylinder, installing a degradable plug within the first channel, deploying the casing segment downhole, and exposing the degradable plug to the degrading fluid stored in the fluid reservoir to cause the downhole tool to be in fluid communication with the interior surface of the cylinder, said degrading fluid concurrently not degrading to the cylinder or the downhole tool.

Each of embodiments A and B may have one or more of the following additional elements in any combination: Element 1: wherein the downhole tool comprises a gauge in fluid communication with the interior surface of the cylinder via the first channel, wherein the gauge monitors one or more properties of borehole fluid present in an interior of the cylinder. Element 2: wherein the downhole tool comprises a chemical injector in fluid communication with the interior surface of the cylinder via the first channel, wherein the chemical injector is operable to inject a fluid into an interior of the cylinder via the first channel. Element 3: wherein the first channel comprises a threaded or shaped portion to secure the degradable plug in the channel. Element 4: wherein the degradable plug comprises a degradable material selected from the group consisting of a degradable polymer, an oil-degradable polymer, a dehydrated salt, a galvanically-corrodible metal, and any combination thereof. Element 5: wherein the degradable polymer is selected from the group consisting of polyglycolic acid, polylactic acid, polylactic co-glycolic acid, and any combination thereof. Element 6: wherein the degradable plug degrades at a predetermined rate upon exposure to the degrading fluid.

Element 7: wherein the degrading fluid comprises aqueous fluid, brine or other salt fluids, drilling mud, and any combination thereof. Element 8: further comprising a second channel that intersects the first channel, wherein the downhole tool is in fluid communication with the interior surface of the cylinder via the first and second channels. Element 9: further comprising a controllable valve that controls an amount of fluid communication between the degrading fluid stored by the fluid reservoir and the degradable plug. Element 10: further comprising a fluid circulation system to direct the degrading fluid stored by the fluid reservoir to contact the degradable plug. Element 11: wherein the degradable plug comprises two portions having different rates of degrading when exposed to the degrading fluid. Element 12: further comprising selecting one of a plurality of degradable plug options to vary a rate of degrading of the degradable plug during said exposing. Element 13: further comprising selecting one of a plurality of degrading fluid options to vary a rate of degrading for the degradable plug during said exposing. Element 14: further comprising selecting an amount of contact area between the degrading fluid and the degradable plug to vary a rate of degrading for the degradable plug during said exposing. Element 15: further comprising selecting a flow rate for the degrading fluid to vary a rate of degrading for the degradable plug during said exposing. Element 16: further comprising using the downhole tool to measure a temperature or pressure of fluid inside the cylinder after said exposing. Element 17: further comprising using the downhole tool to inject chemicals into fluid inside the cylinder after said exposing.

Numerous other modifications, equivalents, and alternatives, will become apparent to those skilled in the art once the above disclosure is fully appreciated. It is intended that the following claims be interpreted to embrace all such modifications, equivalents, and alternatives where applicable.

What is claimed is:

1. A casing segment, comprising:

a casing wall;

a downhole tool positioned along an outside surface of the casing wall, wherein the downhole tool is configured to monitor or modify properties of fluid inside the casing segment;

a first channel in the casing wall establishing fluid communication between the downhole tool and an interior surface of the casing wall;

a degradable plug deployed at least partially through the casing wall and within the first channel, wherein the degradable plug is configured to degrade in response to contact with a degrading fluid to cause the downhole tool to be in fluid communication with the interior surface of the casing wall; and a fluid reservoir for storing a volume of the degrading fluid, wherein, prior to deploying the casing segment downhole, the fluid reservoir is filled with the degrading fluid at the earth's surface and the degrading fluid is always in direct contact with the at least one degradable plug from a time of filling the fluid reservoir until the at least one degradable plug completely degrades.

2. The casing segment of claim 1, wherein the downhole tool comprises a gauge in fluid communication with the interior surface of the casing wall via the first channel, wherein the gauge monitors one or more properties of borehole fluid present in an interior of the casing wall.

3. The casing segment of claim 1, wherein the downhole tool comprises a chemical injector in fluid communication with the interior surface of the casing wall via the first channel, wherein the chemical injector is operable to inject a fluid into an interior of the casing wall via the first channel.

4. The casing segment of claim 1, wherein the first channel comprises a threaded or shaped portion to secure the degradable plug in the channel.

5. The casing segment of claim 1, wherein the degradable plug comprises a degradable material selected from the group consisting of a degradable polymer, an oil-degradable polymer, a dehydrated salt, a galvanically-corrodible metal, and any combination thereof.

6. The casing segment of claim 5, wherein the degradable polymer is selected from the group consisting of polyglycolic acid, polylactic acid, polylactic co-glycolic acid, and any combination thereof.

7. The casing segment of claim 1, wherein the degradable plug degrades at a predetermined rate upon exposure to the degrading fluid.

8. The casing segment of claim 1, wherein the degrading fluid comprises aqueous fluid, brine or other salt fluids, drilling mud, and any combination thereof.

9. The casing segment of claim 1, further comprising a second channel that intersects the first channel, wherein the downhole tool is in fluid communication with the interior surface of the casing wall via the first and second channels.

10. The casing segment of claim 1, further comprising a controllable valve that controls an amount of fluid communication between the degrading fluid stored by the fluid reservoir and the degradable plug.

11. The casing segment of claim 1, further comprising a fluid circulation system to direct the degrading fluid stored by the fluid reservoir to contact the degradable plug.

12. The casing segment of claim 1, wherein the degradable plug comprises two portions having different rates of degrading when exposed to the degrading fluid.

13. A method, comprising:

obtaining a casing segment having a casing wall, a downhole tool positioned along an outside surface of the casing wall, and a fluid reservoir with a volume of degrading fluid, wherein the casing wall includes a first channel establishing fluid communication between the downhole tool and an interior surface of the casing wall;

installing a degradable plug at least partially through the casing wall and within the first channel;

deploying the casing segment downhole; and exposing the degradable plug to the degrading fluid stored in the fluid reservoir to cause the downhole tool to be in fluid communication with the interior surface of the casing wall, wherein:

the downhole tool is configured to monitor or modify properties of fluid inside the casing segment;

the fluid reservoir is filled with the degrading fluid at the earth's surface prior to the deploying the casing segment downhole; and the degrading fluid is always in direct contact with the at least one degradable plug from a time of filling the fluid reservoir until the at least one degradable plug completely degrades.

14. The method of claim 13, further comprising selecting one of a plurality of degradable plug options to vary a rate of degrading of the degradable plug during said exposing.

15. The method of claim 13, further comprising selecting one of a plurality of degrading fluid options to vary a rate of degrading for the degradable plug during said exposing.

16. The method of claim 13, further comprising selecting an amount of contact area between the degrading fluid and the degradable plug to vary a rate of degrading for the degradable plug during said exposing.

17. The method of claim 13, further comprising selecting a flow rate for the degrading fluid to vary a rate of degrading for the degradable plug during said exposing.

18. The method of claim 13, further comprising using the downhole tool to measure a temperature or pressure of fluid inside the casing wall after said exposing.

19. The method of claim 13, further comprising using the downhole tool to inject chemicals into fluid inside the casing wall after said exposing.

* * * * *